US007168635B2

(12) United States Patent
Amaduzzi

(10) Patent No.: US 7,168,635 B2
(45) Date of Patent: Jan. 30, 2007

(54) ADJUSTABLE DETERGENT DISPENSER FOR WATER CLEANERS

(75) Inventor: Roberto Amaduzzi, Rubiera (IT)

(73) Assignee: Arrow Line S.R.L., Rubiera (IT)

( * ) Notice: Subject to any disclaimer, the term of this patent is extended or adjusted under 35 U.S.C. 154(b) by 55 days.

(21) Appl. No.: 10/623,566

(22) Filed: Jul. 22, 2003

(65) Prior Publication Data

US 2004/0118944 A1 Jun. 24, 2004

(30) Foreign Application Priority Data

Oct. 31, 2002 (IT) ..... RE2002A0082

(51) Int. Cl.
*B05B 7/30* (2006.01)

(52) U.S. Cl. ..... 239/318; 239/354

(58) Field of Classification Search ..... 239/310, 239/315, 316, 318, 344, 354; 222/464.1, 222/310, 282

See application file for complete search history.

(56) References Cited

U.S. PATENT DOCUMENTS

| | | | | |
|---|---|---|---|---|
| 2,788,244 | A * | 4/1957 | Gilmour | 239/73 |
| 3,042,314 | A * | 7/1962 | Packard et al. | 239/347 |
| 3,324,903 | A * | 6/1967 | Hinz | 141/17 |
| 3,381,845 | A * | 5/1968 | MacDonald | 220/301 |
| 3,655,096 | A | 4/1972 | Easter | |
| 4,369,921 | A | 1/1983 | Beiswenger et al. | |
| 4,475,689 | A | 10/1984 | Hauger et al. | |

* cited by examiner

*Primary Examiner*—Christopher Kim
(74) *Attorney, Agent, or Firm*—Young & Thompson

(57) ABSTRACT

With the dispenser the flow rate of detergent can be adjusted in accordance with the water flow rate. The dispenser comprises an aspiration conduit connected to the expansion chamber of an ejector by a channel fashioned radially on a head of the aspiration conduit. The height of the channel can be changed by rotating the head with respect to the body of the dispenser.

13 Claims, 3 Drawing Sheets

ADJUSTABLE DETERGENT DISPENSER FOR WATER CLEANERS

BACKGROUND OF THE INVENTION

The invention relates to a water cleaner in which the operator can easily regulate the quantity of a detergent which is dispensed in relation to a quantity of water delivered.

In the field of equipment and spray-guns for water-cleaners, the prior art teaches application downstream of the gun of devices for injecting a predetermined dose of detergent into the water.

These devices aspirate detergent from a special container employing a Venturi-type effect, in which a depression is created in an expansion chamber as a result of the velocity of the water pumped by the cleaner.

The prior art also includes devices enabling a regulation of the delivery of the detergent, i.e. a change in ratio between aspirated detergent delivery and water delivery.

These known devices are generally constituted by a calibrated nozzle inserted in the detergent aspiration conduit, the nozzle being interchangeable. Thus by changing the nozzle the detergent flow rate is also changed.

Other known detergent dispensers with regulatable delivery include a vacuum-breaker valve on the expansion chamber. The vacuum-breaker can be calibrated, so the degree of vacuum can be varied in the expansion chamber and therefore the aspirated detergent fluid can also be regulated.

The above-described devices present various drawbacks. Firstly, the nozzles inserted on the detergent aspiration conduit are subject to blockages during operation, reducing or even interrupting delivery of the detergent.

Further, it is a nuisance to have to substitute the nozzle according to the detergent and flow rate required, as it involves having replacement nozzles to hand, which is not always the case with water cleaning apparatus.

Finally, it is not immediately obvious which nozzle is installed due to poor legibility from the outside, so the flow rate ratio, i.e. the ratio between the detergent and water delivery, is not evident unless the nozzle is first dismounted and/or replaced.

In the case of regulation devices equipping vacuum-breaker valves, there is a risk of blockage or loss of accuracy, but especially there is a lack of precision in determining the exact value of the desired dispensing ratio.

SUMMARY OF THE INVENTION

The main aim of the present invention is therefore to obviate the above-cited drawbacks present in the prior art, by providing an adjustable detergent dispensing device for water cleaners which has no need of substitution of parts when the flow rate of the detergent is to be changed (i.e. in the change of water/detergent ratio), and in which the selected ratio is clearly legible, and which is easily washable to remove the deposits which inevitably build up in the aspirating conduits due to using a detergent.

BRIEF DESCRIPTION of the DRAWINGS

These and other aims besides are all attained by a regulatable detergent dispensing device for water cleaners, as it is described in the appended claims. Further characteristics and advantages of the present invention will better emerge from the detailed description that follows of a preferred but non-exclusive embodiment of the invention, illustrated purely by way of non-limiting example in the accompanying figures of the drawings, in which:

DESCRIPTION OF THE PREFERRED EMBODIMENTS

Figures 1A, 1B, 1C:
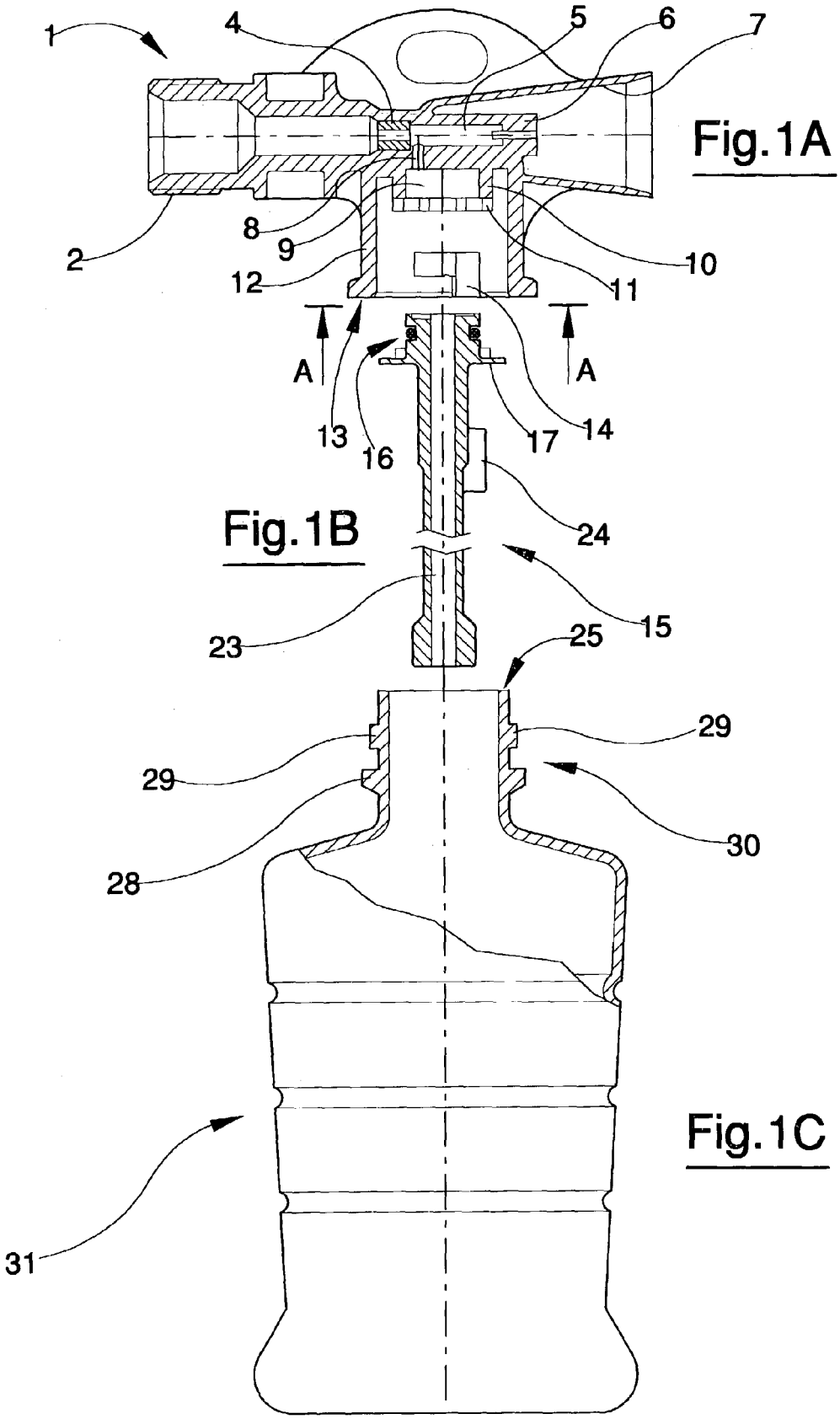
FIGS. 1A, 1B and 1C show, in a vertical axial plane and in section, the three parts which constitute the device, represented in dismounted position according to the vertical insertion axis, and respectively constituted by the body of the device, the aspiration conduit with upper head, and a recipient for containing detergent.

With reference to the figures of the drawings, 1 denotes the body of the device in its entirety; 2 denotes a threading for connection to a water-gun, not shown in the figures.

3 denotes a tapered chamber for containing water under pressure, which ends with a fixed nozzle 4; together, the chamber 3 and the nozzle 4 constitute a water ejector.

5 denotes an expansion chamber in which, by a Venturi effect, a depression is caused by action of an exiting jet from the nozzle 4.

6 represents a nozzle and 7 a delivery mouth for the jet.

8 denotes a hole connecting the expansion chamber 5 with an underlying chamber 9 delimited by the trunco-cylindrical wall 10.

11 denotes a series of notches, arranged in diametrically-opposite couples on the lower edge of the trunco-cylindrical wall 10. The notches 11 are destined to contact respectively with a pair of teeth 20 fashioned on the aspiration conduit 15 head 16, when the aspiration conduit 15 is placed in operating position on the device.

12 denotes a lower connecting portion of the body 1, destined to connect in a bayonet joint with teeth 29 located on the neck 30 of the detergent container 31.

A numbered scale (numbered from 1 to 6, the numbers being equidistanced) is located on the lower edge 13 of the connecting portion 12.

Figures 5A, 5B, 5C:
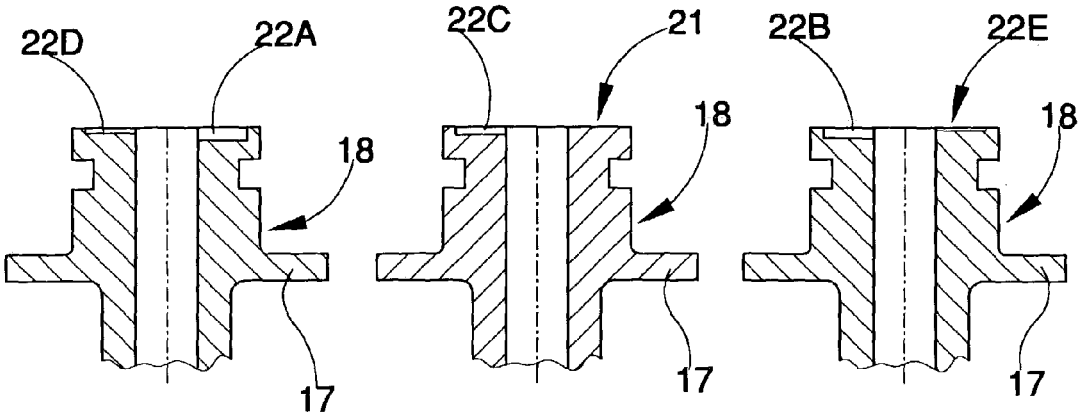
FIGS. 5A, 5B, 5C each show a detail of the aspiration conduit head of FIG. 1B, respectively shown vertically sectioned along lines B—B, C—C and D—D.
Figure 4:
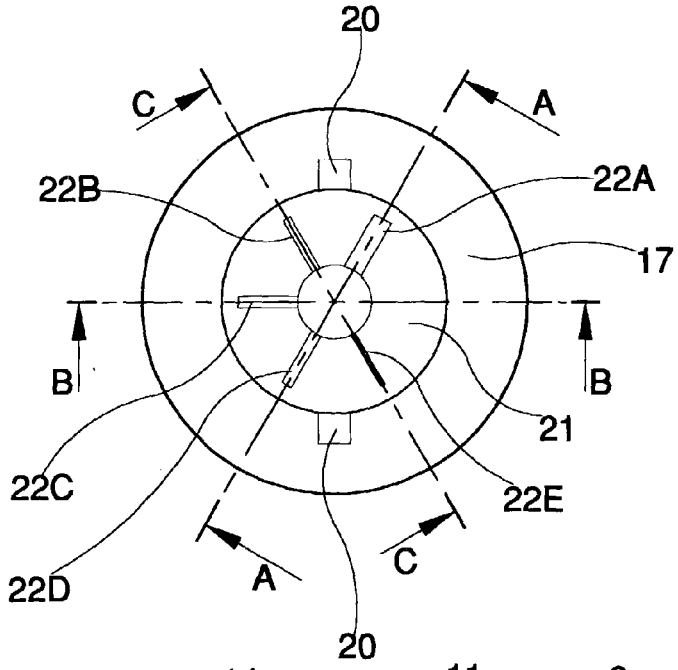
FIG. 4 is a view from above of the head of the aspiration conduit of FIG. 1B.
Figure 3:
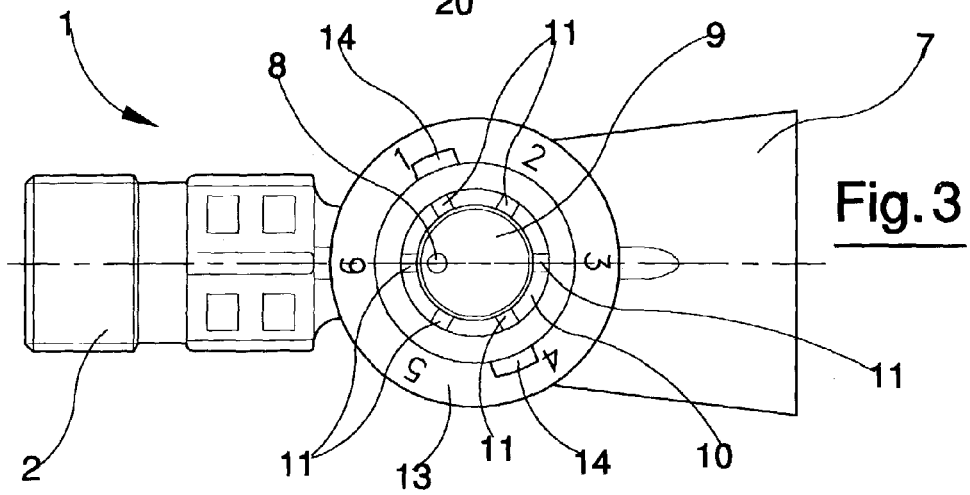
FIG. 3 is a view of the body of the device of FIG. 1A seen from plane A—A in FIG. 1A.

The head 16 of the aspiration conduit 15, shown in detail in FIGS. 4 and 5, is constituted by: a wide plate 17, destined to contact against the trunco-cylindrical wall 10; by a trunco-cylindrical drum 18 an external wall of which exhibits an o-ring 19 made of an elastomer material; and by a flat upper part 21 on which radial channels 22A, 22B, 22C, 22D and 22E are afforded, having different depths and being angularly equidistanced radially and being of a number which corresponds to the numbering written on the lower edge 13 of the connecting portion 12. In the illustrated embodiment, the channels are 5 in number, as there are 6 numbers on the lower edge 13 (a sixth number being zero).

The aspiration conduit 15 is internally hollow and exhibits an axial hole 23, while externally the aspiration conduit 15 exhibits a fixed tab 24 which indicates the angular position of the aspiration conduit 15.

The container 31 of detergent, which can be variously shaped in a main body thereof, at a top thereof exhibits a rigid neck 30 having two joint teeth 29 and a collar 28 which, when the apparatus is assembled, contacts against the internal part of the lower edge 13 of the connecting portion 12.

The above prevalently structural description is now followed by a description of how the invention operates.

Starting from the disassembled situation, represented in FIGS. 1A, 1B and 1C, the operator first inserts the aspiration conduit 15 into the chamber 9 of the body 1 of the device, coupling the drum 18 on the walls 10 of the chamber 9. This coupling is solid thanks to the action of the o-ring 19 on the head of the drum 18, which exerts a mechanical gripping action on the body 1 and the drum 18 as well as a hydraulic sealing action.

The coupling also causes the teeth 20 to couple with a pair of notches 19 in a variety but limited number of positions, which in the embodiment are six in number.

The positions are indicated by the position of the tab 24 with regard to the numbers written on the circular crown of the lower edge 13; thus it is easy to know the angular position in which the head 16 of the aspiration conduit 15 has been installed on the chamber 9.

This tab position indicates a situation in which of one of the channels 22A, 22B, 22C, 22D, 22E coincides with the hole 8 giving access to the expansion chamber 5.

A sixth position is provided, in which there is no coinciding channel 22. This means that in the sixth position the hole 8 is stopped, and the tab at this position will be aligned with position number 0.

Finally the operator inserts the neck 30 of the container 31 on the connecting portion 12, closing the bayonet joint with the teeth 29.

This operation is possible only if the teeth 20 have correctly entered into one of the pair of notches 11. For this reason, the upper edge 25 of the neck 30 strikes against the plate 17, obliging it to settle in the correct position.

Figure 2:
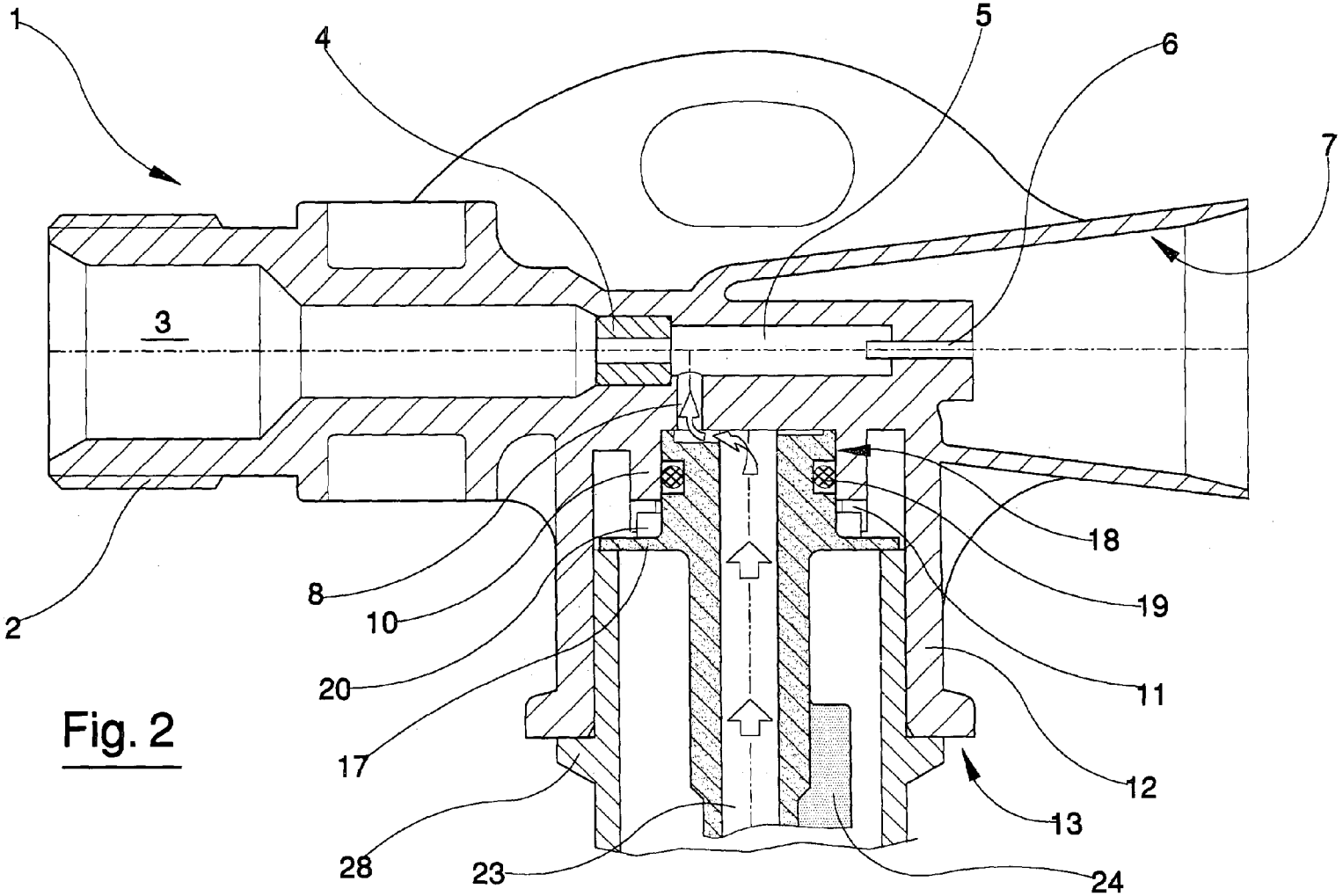
FIG. 2 shows, in a vertical axial plane, and in section, an enlarged detail of the body of the device of FIG. 1A, and the head of the aspiration conduit of FIG. 1B, correctly mounted in operating configuration.

The closure position of the neck 30 is illustrated in FIG. 2.

Should the teeth 20 not enter the notches 19, the bayonet joint involving the teeth 29 of the container neck 30 and the notches 14 will not be properly effected; also, the collar 28 would not perfectly settle on the lower edge 13.

Pressurised water can be introduced into the chamber 3, causing aspiration of the detergent in the pathway connecting the hole 8 with the aspiration conduit 23 through the preselected channel 22.

As the depth of the channels 22 is different, according to the angular position of the conduit 15 the flow rate of the aspirated detergent will be different, as the loss of head in the channel 22 will be of different entities. The height of the channels 22 is comprised in an interval going from 0 (position zero) to 1 mm (deepest channel).

Alternatively to a multiplicity of radial channels 22 having different depths, it would be possible to have a continuous variation in the height of the aspiration conduit head 16 at a channel 22 according to the angular position of the conduit 15. This is obtained by helically shaping the upper part 21 in a wide radial arch shape, starting, for example, from level 0 (zero) and going up to the maximum depth of the deepest channel 22. This would give rise to a helical space between the aspiration conduit head 16 and the body 1 at the chamber 9; and this would lead to a variable height in the helical space at the base of the hole 8, and therefore a different loss of head of the detergent in that zone.

The aim of enabling selection of the most suitable flow rate value is thus achieved, with a simple mounting operation in the desired position of the conduit 15. It is also easy to clean the channels 22 of the connecting conduit between the expansion chamber 5 of the ejector and the aspiration conduit 15, as the latter part can be mounted and dismounted easily from the body 1 of the device.

What is claimed is:

1. An adjustable detergent dispenser for water cleaners, comprising:

at least three elements which can be assembled together, the at least three elements being a body, an aspiration conduit and a container of a detergent; and a radially-directed series of channels afforded on a flat upper part of a head of the aspiration conduit, the channels becoming flow channels only when the head draws up to a bottom of an expansion chamber so as to result in variable-height flow channels being formed between the flat upper part of the head of the aspiration conduit and a mating lower surface of the body, the channels having different heights and the formed flow channels having different heights, the aspiration conduit being connected to an expansion chamber of an ejector of the body through a hole and one of the variable-height flow channels fashioned radially on the upper head of the aspiration conduit, the variable-height flow channels being interchangeable by means of a rotation of the head into at least one different position from an original position thereof with respect to the body of the dispenser.

2. The dispenser of claim 1, wherein the upper part of the head (16) of the aspiration conduit is trunco-cylindrically shaped and that elastic sealing means are provided thereon.

3. The dispenser of claim 2, wherein a plate is provided at a base of the trunco-cylindrically shaped upper part, which plate exhibits in an upper portion thereof at least one tooth, and which plate is supported on assembly of the dispenser by an upper edge of a neck of the container.

4. The dispenser of claim 1, wherein the container exhibits an upper neck provided with teeth suitable for achieving a bayonet joint, and with a collar for striking contact with the body of the dispenser.

5. The dispenser of claim 1, wherein at least one tab is provided on the aspiration conduit; the tab being a radial position indicator.

6. An adjustable detergent dispenser for water cleaners, comprising:

a body with an ejector having an expansion chamber, the expansion chamber comprising an expansion chamber wall hole extending through an outer wall of the expansion chamber;

a detergent container connected to the body; and an aspiration conduit providing a fluid path for extracting detergent held within the detergent container into the expansion chamber, the aspiration conduit comprising a radially-directed series of variable-height channels, with open tops exposed along their entire length, on an uppermost horizontal surface of a head of the aspiration conduit, the open-top channels becoming flow channels only when the head draws up against a bottom of the expansion chamber so to result in variable-height flow channels being afforded on the uppermost surface of the head of the aspiration conduit, a thus-formed flow channel providing a fluid flow inlet at an end of the flow channel and a flow outlet at a thus-formed top exit opening for fluid flow into the body, with the body, via the thus-formed flow channel of the aspiration conduit, being in fluid connection with the detergent container, the variable-height channels being selectable brought into the fluid connection with the expansion chamber wall hole by an angular rotation of the head with respect to the body to bring the expansion chamber wall hole adjacent a selected channel, the uppermost horizontal surface of the head of the aspiration conduit coming into contact with the outer wall of the expansion chamber.

7. An adjustable detergent dispenser for water cleaners, comprising:

a body (1) connected to an aspiration conduit (15), the conduit connectable to a container for holding a detergent, said aspiration conduit comprising a conduit head (16), said body comprising i) a water ejector comprised of a tapered water inlet chamber (3) ending with a fixed nozzle (4), ii) a Venturi expansion chamber (5) terminating with an exit nozzle (6), a depression being caused by action of an exiting jet from the fixed nozzle (4), iii) an underlying chamber (9) underlying the expansion chamber and connectable in fluid communication with the expansion chamber, the underlying chamber delimited by a trunco-cylindrical wall (10), and iv) a connecting portion (12) for connection to the container, the conduit head comprising i) a wide plate (17) destined to contact against the trunco-cylindrical wall, ii) a trunco-cylindrical drum (18), and iii) a flat upper part (21) provided with open top radial channels (22A, 22B, 22C, 22D and 22E), the radial channels having different depths from an upper surface of the flat upper part and open along their entire length when not pressed against the body, wherein, the aspiration conduit is insertable into the underlying chamber (9) of the body, coupling the drum (18) on the trunco-cylindrical wall (10) of the chamber (9), and converting a single one of the open top radial channels into a flow channel by pressing a top of the drum against a mating surface of the body, the pressing causing the open top of the single one radial channel to become the flow channel by the head drawing up into a bottom of the underlying chamber so that only a portion of the top is left open to serve as an exit opening and a remaining portion of the open top is closed to result in a single flow channel being formed.

8. The dispenser of claim 7, wherein, the connecting portion (12) comprises a numbered scale with numbering located on a lower edge (13) thereof, the radial channels are angularly equidistanced radially and are of a number corresponding to the numbering on the lower edge of the connecting portion.

9. The dispenser of claim 8, wherein, the radial channels are five in number, and there are six numbers on the lower edge, one number being zero.

10. The dispenser of claim 8, wherein, the aspiration conduit is internally hollow with an axial hole (23), and the aspiration conduit externally includes a fixed tab (24) which indicates the angular position of the aspiration conduit.

11. The dispenser of claim 10, wherein, the number of a coupling position is indicated by the position of the tab (24) with regard to the numbering on the lower edge (13), thereby indicating the angular position in which the head of the aspiration conduit has been installed on the underlying chamber.

12. The dispenser of claim 10, wherein, the underlying chamber (9) is in fluid communication with the expansion chamber via a hole (8), and the tab position indicates a situation in which one of the channels (22A, 22B, 22C, 22D, 22E) is a preselected channel that coincides with the hole providing fluid access to the expansion chamber, and pressurised water introduced into the inlet chamber causes aspiration of the detergent in a pathway connecting the hole with the aspiration conduit through the preselected channel 22, and as the depth of the channels is different, the preselected channel, as determined by the angular position of the conduit, determines the flow rate of the aspirated detergent.

13. The dispenser of claim 7, wherein, inserting the neck (30) of the container onto the connecting portion (12), connects the body with the container only when correctly coupled, with an upper edge (25) of the neck striking against the wide plate (17).

* * * * *